US007856189B2

(12) United States Patent
Ishibashi

(10) Patent No.: US 7,856,189 B2
(45) Date of Patent: Dec. 21, 2010

(54) IMAGE FORMING APPARATUS AND A METHOD OF EFFECTIVELY DETECTING TONER STATE IN THE SAME

(75) Inventor: Mikio Ishibashi, Tokyo (JP)

(73) Assignee: Ricoh Company, Ltd, Tokyo (JP)

( * ) Notice: Subject to any disclaimer, the term of this patent is extended or adjusted under 35 U.S.C. 154(b) by 861 days.

(21) Appl. No.: 11/520,804

(22) Filed: Sep. 14, 2006

(65) Prior Publication Data

US 2007/0058998 A1 Mar. 15, 2007

(30) Foreign Application Priority Data

Sep. 14, 2005 (JP) ..... 2005-266570

(51) Int. Cl.
*G03G 15/10* (2006.01)

(52) U.S. Cl. ..... 399/61; 399/62; 399/63; 399/64; 399/258; 399/262

(58) Field of Classification Search ..... 399/27–30, 399/61–64, 258–260, 262
See application file for complete search history.

(56) References Cited

U.S. PATENT DOCUMENTS 4,952,976 A * 8/1990 Katoh et al. ..... 399/27
5,227,847 A * 7/1993 Motohashi et al. ..... 399/27
5,351,107 A * 9/1994 Nakane et al. ..... 399/49
5,486,901 A * 1/1996 Fukuchi et al. ..... 399/40
5,512,980 A * 4/1996 Yamaguchi et al. ..... 399/59
5,596,390 A * 1/1997 Sawada ..... 399/8
5,754,916 A * 5/1998 Kitayama et al. ..... 399/27
5,826,134 A * 10/1998 Hino et al. ..... 399/27
5,943,525 A * 8/1999 Endo et al. ..... 399/27

(Continued)

FOREIGN PATENT DOCUMENTS

JP 06-324569 11/1994

(Continued)

OTHER PUBLICATIONS

English translation of Takanuma (JP pub 06-324569); published Nov. 25, 1994.*

(Continued)

*Primary Examiner*—David M Gray
*Assistant Examiner*—Geoffrey T Evans
(74) *Attorney, Agent, or Firm*—Oblon, Spivak, McClelland, Maier & Neustadt, L.L.P.

(57) ABSTRACT

An image forming apparatus includes an optical sensor configured to optically detect a density of a reference pattern image, a toner density sensor configured to detect a density of toner in a developing unit, a storing unit configured to store an image area coverage of an output image, a determining unit configured to determine whether a state of toner accommodated in a toner supplying unit is an almost empty state and an empty state or neither based on detection results obtained by the sensors, a controlling unit configured to continuously perform a toner state check when the image area coverage of the output image is greater than a predetermined image area coverage value and the density of the reference pattern image is greater than a predetermined density level after the determination of the state of toner is the almost empty state or the empty state or neither.

12 Claims, 7 Drawing Sheets

U.S. PATENT DOCUMENTS

| | | | | |
|---|---|---|---|---|
| 6,160,969 | A * | 12/2000 | Ishigaki et al. | 399/49 |
| 6,347,199 | B1 * | 2/2002 | Morihara | 399/27 |
| 6,349,183 | B1 * | 2/2002 | Nagamine et al. | 399/27 |
| 6,704,521 | B2 * | 3/2004 | Isobe et al. | 399/12 |
| 7,013,096 | B2 * | 3/2006 | Ozawa et al. | 399/58 |
| 7,050,729 | B2 * | 5/2006 | Fujiwara | 399/27 |
| 7,113,711 | B2 * | 9/2006 | Okamura | 399/27 |
| 7,149,438 | B2 * | 12/2006 | Sasaki | 399/27 |
| 7,203,431 | B2 * | 4/2007 | Shoji et al. | 399/9 |
| 7,251,420 | B2 * | 7/2007 | Fujimori et al. | 399/27 |
| 7,280,773 | B2 * | 10/2007 | Uno | 399/27 |
| 7,327,962 | B2 * | 2/2008 | Shoji et al. | 399/9 |
| 7,333,739 | B2 * | 2/2008 | Miyata | 399/27 |
| 7,400,837 | B2 * | 7/2008 | Koyama | 399/27 |
| 7,415,214 | B2 * | 8/2008 | Sakita et al. | 399/27 |
| 7,532,828 | B2 * | 5/2009 | Komiya et al. | 399/27 |
| 7,536,121 | B2 * | 5/2009 | Shimizu et al. | 399/27 |
| 7,565,085 | B2 * | 7/2009 | Okuyama et al. | 399/27 |
| 7,619,791 | B2 * | 11/2009 | Itoyama et al. | 358/504 |
| 7,684,715 | B2 * | 3/2010 | Zaima | 399/27 |
| 2003/0123889 | A1 * | 7/2003 | Isobe et al. | 399/27 |
| 2004/0080783 | A1 * | 4/2004 | Owen et al. | 358/1.15 |
| 2004/0184826 | A1 * | 9/2004 | Ozawa et al. | 399/30 |
| 2005/0185973 | A1 * | 8/2005 | Hama et al. | 399/27 |
| 2006/0002724 | A1 * | 1/2006 | Fujimori et al. | 399/27 |
| 2006/0104648 | A1 * | 5/2006 | Sasaki | 399/12 |
| 2006/0127109 | A1 * | 6/2006 | Itoyama et al. | 399/27 |
| 2006/0152775 | A1 * | 7/2006 | Itoyama et al. | 358/504 |
| 2007/0206037 | A1 * | 9/2007 | Hasegawa et al. | 347/7 |
| 2010/0086320 | A1 * | 4/2010 | Koizumi et al. | 399/30 |

FOREIGN PATENT DOCUMENTS

| | | |
|---|---|---|
| JP | 09-179396 | 7/1997 |
| JP | 10-123820 | 5/1998 |
| JP | 11-065259 | 3/1999 |

OTHER PUBLICATIONS

U.S. Appl. No. 11/925,266, filed Oct. 26, 2007, Koinuma, et at.
U.S. Appl. No. 11/958,054, filed Dec. 17, 2007, Sudo, et al.

* cited by examiner

IMAGE FORMING APPARATUS AND A METHOD OF EFFECTIVELY DETECTING TONER STATE IN THE SAME

CROSS REFERENCE TO RELATED APPLICATIONS

The present application claims priority to Japanese Patent application no. 2005-266570, filed in the Japan Patent Office on Sep. 14, 2005, the disclosure of which is incorporated by reference herein in its entirety.

BACKGROUND OF THE INVENTION

1. Field of the Invention

The present invention relates to an electrophotographic image forming apparatus and a method of detecting a toner state, more particularly to an image forming apparatus configured to detect a toner almost empty state or a toner empty state or neither, accommodated in a toner supplying unit and a method of detecting the toner state in the image forming apparatus.

2. Discussion of the Related Art

In an image forming apparatus using a two-component developer in which toner and carrier are mixed, as a developing unit consumes more toner for image forming, an image density of a printed image becomes lower. A toner density sensor that is disposed in the developing unit detects a toner density, and toner is accordingly supplied from a toner supplying unit or a toner cartridge to the developing unit when the toner density becomes low, so that the toner density in the developing unit may constantly be maintained within the appropriate range.

When toner remaining in the toner supplying unit becomes almost or completely empty, the toner supplying unit may need to be replenished with toner.

To allow time to obtain a new toner supplying unit or toner cartridge, it is preferable that a warning that the toner is becoming empty or a message indicating a toner almost empty state be displayed when the toner supplying unit still holds an amount of toner for printing some dozens of images.

There are some techniques to detect the toner almost empty state of the toner remaining in the toner supplying unit. In one technique, for example, a sensor is used to detect a torque of a toner agitator mounted in the toner supplying unit. When the torque becomes below a predetermined level, the toner almost empty state is displayed. However, the detection accuracy of torque may gradually decrease when the amount of remaining toner in the toner supplying unit becomes lower.

A background image forming apparatus for detecting and accurately determining a toner empty state in a toner supplying unit includes an optical writing unit for forming an electrostatic latent image, a developing unit for developing the electrostatic latent image, a toner accommodating unit for accommodating toner to be supplied to the developing unit, a plurality of toner containers detachable with respect to the toner accommodating unit for containing the toner to be supplied to the toner accommodating unit, a remaining toner detecting unit for detecting the amount of remaining toner in the toner container, and a development ability detecting unit for detecting ability of the developing unit. The above-described image forming apparatus further includes a toner almost empty state determining unit for determining a toner almost empty state based on the detection result that the toner in the toner container becomes completely or almost empty, and a toner empty state determining unit for determining a toner empty state based on the image data of an image to be formed after the toner almost empty state is determined by the toner almost empty state determining unit and the detection result of development ability obtained by the development ability detecting unit.

A different background image forming apparatus uses a dot counter and a toner density sensor in detecting the toner almost empty state and the toner empty state for achieving simplification as well as cost reduction of the background image forming apparatus. The image forming apparatus includes the dot counter for counting the number of dots of a formed image, a developing unit including the toner density sensor, a laser writing unit, and a detecting unit for detecting the toner almost empty state according to the result value of the dot counter and detecting the toner empty state according to the result of the toner density sensor.

A different background image forming apparatus employs a photoelectrical sensor or a P-sensor. The P-sensor is widely used to detect the density of developer so that the image density can be maintained in a constant range.

In this image forming apparatus, an electrostatic latent image of a reference density pattern is formed on a surface of an image bearing member of the image forming apparatus, by scanning the reference density pattern that is provided at a lower position of a side scale on a contact glass of the image forming apparatus or by scanning the image bearing member by a laser light beam that repeatedly blinks at a constant interval of time. The developing unit develops the electrostatic latent image of the reference density pattern to form a visible pattern. The P-sensor detects the toner density of the visible pattern and the toner density of the background area of the image bearing member in a unit of voltage.

The toner density detection may be performed after printing every 10 copies, for example. For example, when a the Vsp/Vsg value becomes equal to or less than 1/10, in which "Vsp" represents a voltage corresponding to the toner density of the visible pattern and "Vsg" represents a voltage corresponding to the toner density of the background area of the image bearing member, the P-sensor determines whether the ratio of toner in the developer has fallen below the predetermined amount. Then, the toner supplying unit supplies toner to the developing unit continuously until the Vsp/Vsg value becomes greater than 1/10.

Referring to FIGS. 1 and 2, flowcharts of background operations for detecting toner states are described.

FIG. 1 shows the operation flowchart of a toner almost empty detecting check of a background image forming apparatus.

A toner empty sensor serving as an optical detecting unit is disposed in a toner conveying path. The toner empty sensor determines whether the toner almost empty state of a toner supplying unit has been detected in step S1.

When the toner empty sensor has detected the toner almost empty state (YES in step S1), the image forming apparatus sets a toner almost empty flag and shows a toner almost empty signal to inform a user of the toner almost empty state in step S2.

Even when the toner empty sensor has not yet detected the toner almost empty state (NO in step S1), the image forming apparatus obtains a difference between a target toner density (Vref) and the current toner density (Vt) in step S3.

When the difference exceeds a predetermined value, 0.4V for example, continuously for a given number "n" of transfer sheets (YES in step S3), the process goes to step S2 so as to set the toner almost empty flag and show the toner almost empty signal.

When the difference stays 0.4V or below (NO in step S3, the toner almost empty flag is left unset in step S4.

FIG. 2 shows the operation flowchart of a toner empty detecting check of the background image forming apparatus.

The toner empty sensor determines whether the toner almost empty state of the toner supplying unit has been detected in step S11.

When the toner empty sensor has detected the toner almost empty state (YES in step Sll), the image forming apparatus determines whether a specific number of pixels has been output in step S12.

When the specific number of pixels has been output (YES in step S12), the image forming apparatus sets a toner empty flag and shows a toner empty signal to inform a user of the toner empty state in step S13.

Even when the toner empty sensor has not yet detected the toner almost empty state (NO is step S11), the image forming apparatus obtains a difference between a target toner density (Vref) and the current toner density (Vt) in step S14.

When the difference exceeds a predetermined value, 0.5V for example, continuously for a given number "n" of transfer sheets (YES in step s14), the process goes to step S13 so as to set the toner empty flag and show the toner empty signal.

When the difference stays 0.5V or below (NO in step s14), the toner empty flag is left unset in step S15.

When a small amount of toner remains in the toner supplying unit, however, the replenishment of sufficient toner cannot be supplied to the developing unit even though instructions for supplying toner are repeatedly sent, and the toner density of image pattern area cannot recover to the predetermined acceptable range. When the above-described situation occurs, the toner empty sensor determines the toner almost empty state and the warning is displayed on a console or a message window.

As previously described, the P-sensor determines the toner almost empty state according to the toner density of a visible pattern. Therefore, when images having high image area coverage are continuously formed or when the potentials are varied, the toner almost empty state may be detected and the toner almost empty signal may be consequently displayed even when the toner is sufficiently contained in the toner supplying unit. In this case, the entire system is caused to stop, which has caused the toner contained in the toner supplying unit not to be effectively used until the end of toner.

Further, an optically transparent material is used for a portion of the toner conveying path in the toner supplying unit so as to detect the amount of remaining toner in the toner supplying unit according to the amount of transmitted light. However, the detection accuracy may degrade when a portion of the toner conveying path is contaminated.

Further, a magnetic permeability sensor is used for detecting the toner density in a two-component developer so as to calculate the difference between the toner density and a target toner density. When the difference exceeds a predetermined level, the toner in the toner supplying unit is determined to be in the toner almost empty state.

However, when the image area coverage of output image sharply increases or decreases or when the environmental condition around the image forming apparatus greatly changes, the volume of the developer may change. The magnetic permeability sensor can cause erroneous detections of the toner under the above-described condition. Especially, when images having high image area coverage are sequentially output, the detection level of density of the sensor may shift to a lighter level.

SUMMARY OF THE INVENTION

One illustrative embodiment of the present invention provides a novel image forming apparatus that can effectively detect a toner state.

Other illustrative embodiments provide a novel method of detecting a toner state in the above-described novel image forming apparatus.

In one exemplary embodiment, a novel image forming apparatus includes an optical sensor configured to optically detect a density of a reference pattern image at intervals of printing a predetermined number of transfer sheets, a toner density sensor configured to detect a density of toner included in a two-component developer accommodated in a developing unit, a storing unit configured to store an image area coverage of each color of an output image, a determining unit configured to determine whether a state of toner accommodated in a toner supplying unit is an almost empty state or an empty state, or neither, based on detection results obtained by the optical sensor and toner density sensor, and a controlling unit configured to control to continuously perform a toner state check when the image area coverage of the output image is greater than a predetermined image area coverage value and the density of the reference pattern image is greater than a predetermined density level, even after the toner density sensor detects a low density of toner and the determining unit determines the state of toner is the almost empty state or the empty state or neither.

An average image area coverage of a predetermined number of printed sheets may be obtained and compared with a reference image area coverage so that the controlling unit can control to determine whether the state of toner is the almost empty state or the empty state or neither.

The controlling unit may delete data of the average image area coverage when the two-component developer in the developing unit is replaced.

The controlling unit may delete data of the average image area coverage when the developing unit is replaced.

Further, in one exemplary embodiment, a novel method of detecting a toner state includes optically detecting a density of a reference pattern image at intervals of printing a predetermined number of transfer sheets, detecting a density of toner included in a two-component developer accommodated in a developing unit, storing an image area coverage of each color of an output image, determining whether a state of toner accommodated in a toner supplying unit is the almost empty state or an empty state or neither based on detection results obtained by the optical sensor and toner density sensor, and performing a toner state check continuously when the image area coverage of the output image is greater than a predetermined image area coverage value and the density of the reference pattern image is greater than a predetermined density level even after the toner density sensor detects a low density of toner and the determining unit determines the state of toner is the almost empty state or the empty state or neither.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
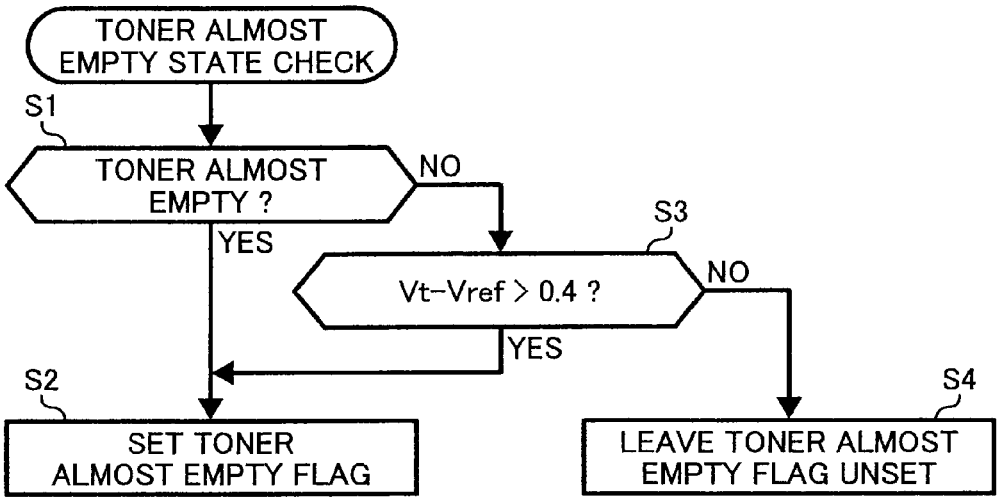
FIG. 1 BACKGROUND ART
FIG. 1 is a flowchart of an operation performed by a background image forming apparatus.
Figure 2:
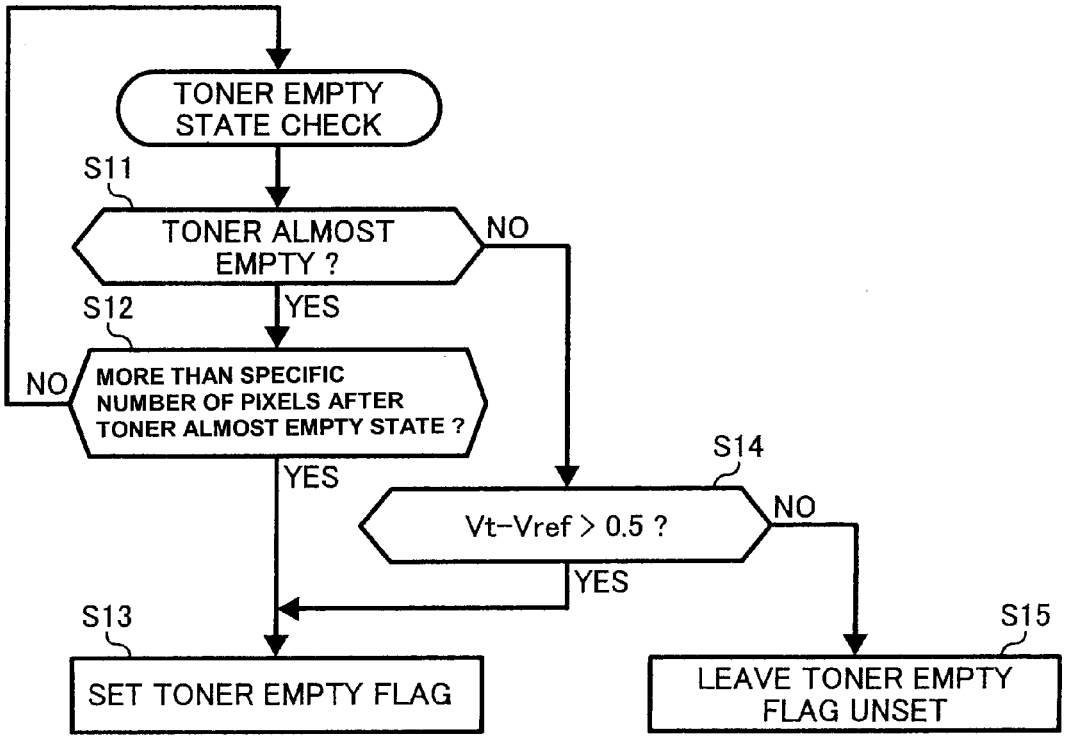
FIG. 2 BACKGROUND ART
FIG. 2 is a flowchart of a different operation performed by the background image forming apparatus of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

It is important to note that, in the exemplary embodiments hereinafter described, an optical sensor corresponds to photosensors 15*a* and 15*b*. A toner density sensor corresponds to a magnetic permeability sensor 13. A storing unit corresponds to an image pixel memory 22. A determining unit corresponds to a CPU 20 of an image forming apparatus 100. A controlling unit corresponds to the CPU 20.

Figure 3:
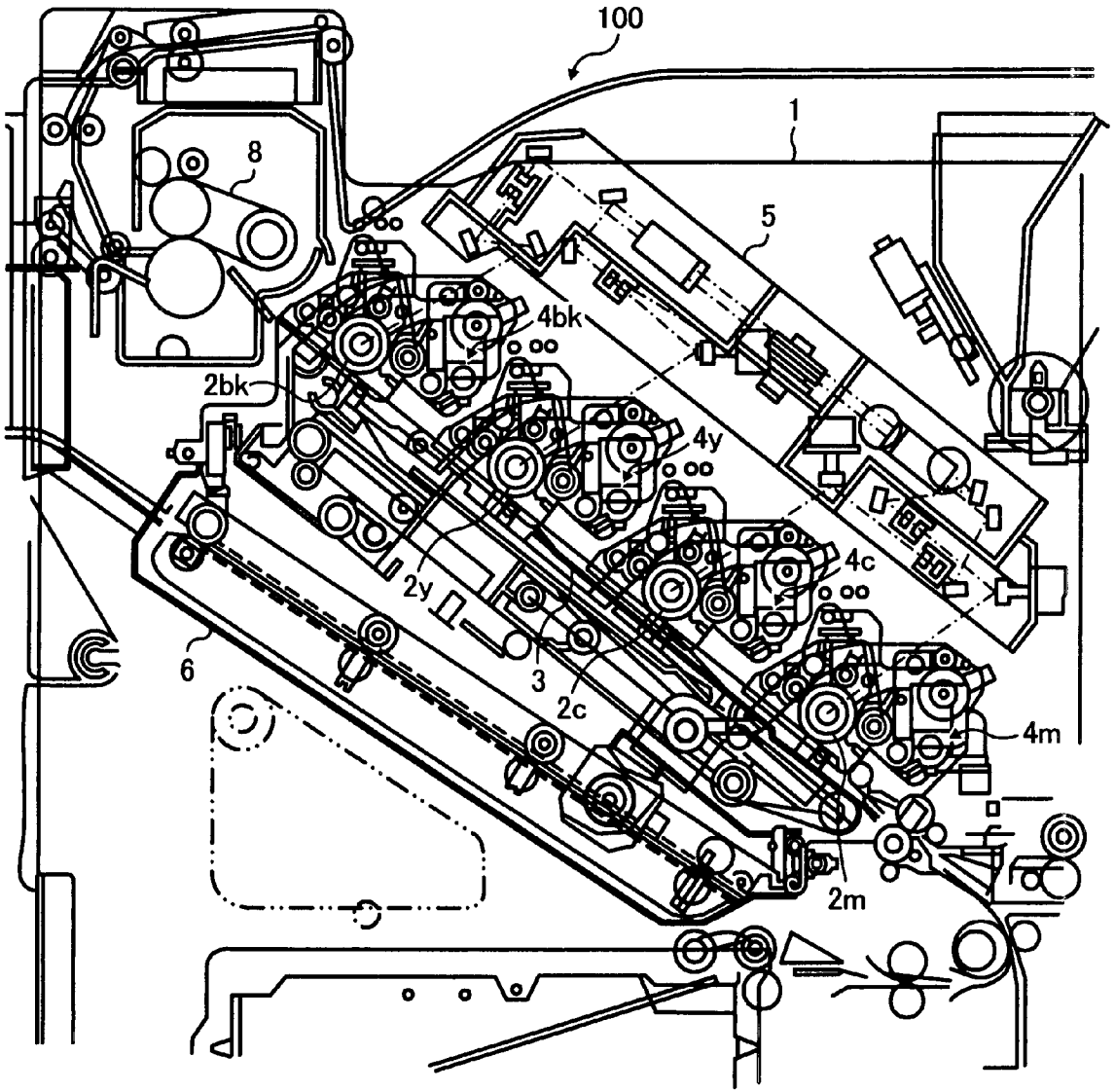
FIG. 3 is a schematic structure of an image forming apparatus according to one exemplary embodiment of the present invention.
Figure 4:
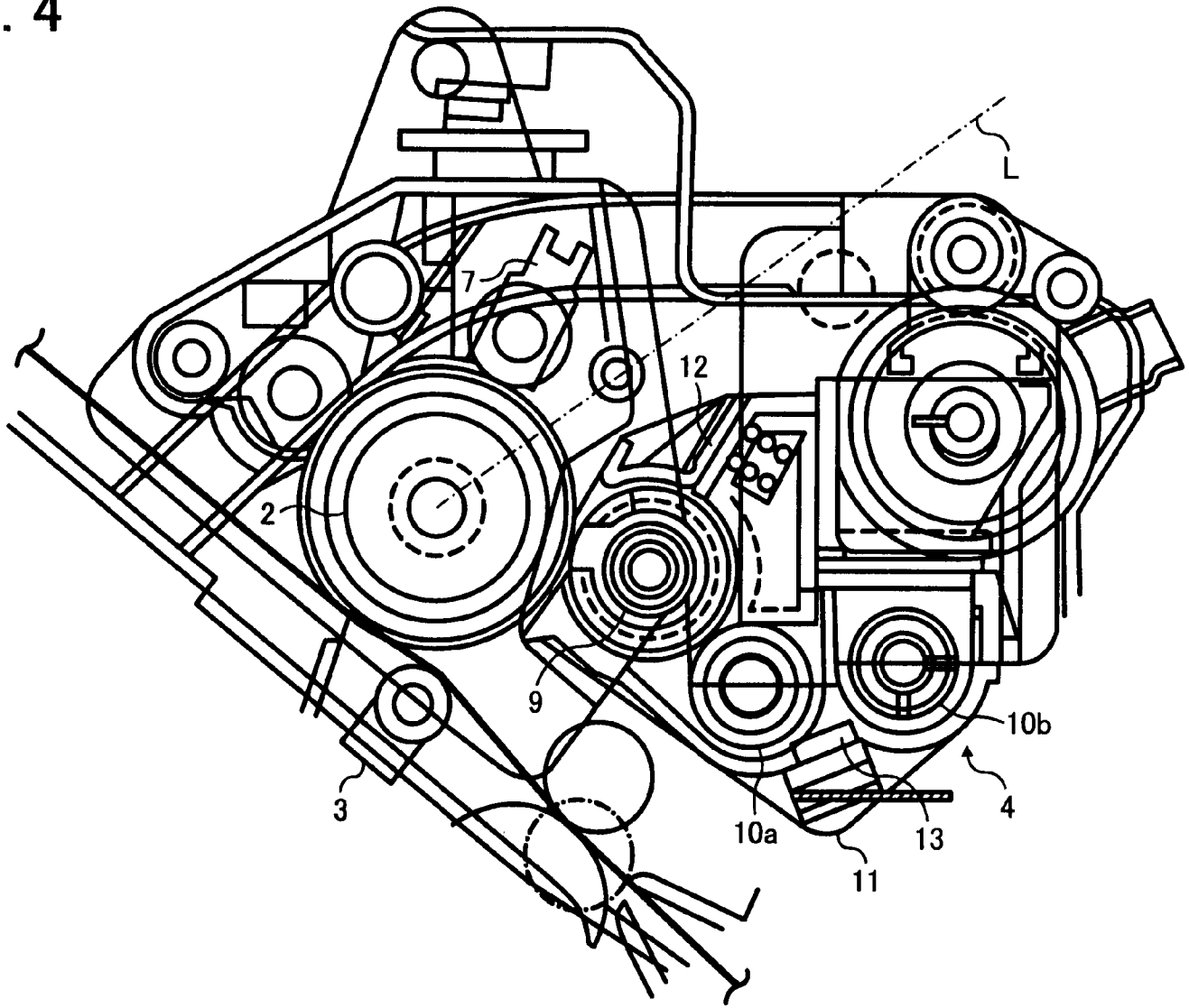
FIG. 4 is an enlarged view of a photoconductive element and a developing unit of the image forming apparatus of FIG. 3, according to an exemplary embodiment of the present invention.

Referring to FIGS. 3 and 4, a schematic structure of an image forming apparatus 100 according to an exemplary embodiment is described.

FIG. 3 depicts the schematic structure of the image forming apparatus 100, and FIG. 4 is an enlarged view of the structure of a photoconductive element and a developing unit shown in FIG. 3.

In FIG. 3, the image forming apparatus 100 employs an electrophotographic method to produce full-color images by using four photoconductive drums.

Specifically, the image forming apparatus 100 has a main body 1 that includes a plurality of photoconductive drums 2*m*, 2*c*, 2*y*, and 2*bk*, a transfer belt 3, a plurality of developing units 4*m*, 4*c*, 4*y*, and 4*bk*, an optical writing unit 5, a duplex printing unit 6, a charging roller 7 (see FIG. 4), and a fixing unit 8.

Each of the plurality of photoconductive drums 2*m*, 2*c*, 2*y*, and 2*bk* has a cylindrical shape. The plurality of photoconductive drums 2*m*, 2*c*, 2*y*, and 2*bk* are disposed at predetermine intervals, along a moving direction of the transfer belt 3, and are held in contact with an outer surface of the transfer belt 3.

The photoconductive drum 2*m* is used to form a single color image corresponding to a magenta toner image. The photoconductive drum 2*c* is used to form a different single color image corresponding to a cyan toner image. The photoconductive drum 2*y* is used to form a different single color image corresponding to a yellow toner image. The photoconductive drum 2*bk* is used to form a different single color image corresponding to a black toner image.

The transfer belt 3 that forms an endless belt is disposed opposite to the plurality of photoconductive drums 2*m*, 2*c*, 2*y*, and 2*bk*, and rotates in a counterclockwise direction in FIG. 1. The transfer belt 3 conveys a recording medium so as to transfer the respective single toner images onto the recording medium by overlying the single toner images as a color toner image.

The plurality of developing units 4*m*, 4*c*, 4*y*, and 4*bk* in FIG. 3 contain respectively a two-component developer therein for producing single toner images with toners of different colors of magenta (*m*), cyan (*c*), yellow (*y*), and black (*bk*). The plurality of developing units 4*m*, 4*c*, 4*y*, and 4*bk* can separately be detached from the main body of the image forming apparatus 100 for the replacement of the component when the life of the component ends. Further, the two-component developer accommodated in each of the developing units 4*m*, 4*c*, 4*y*, and 4*bk* can be replaced when the developer has abraded or worn away.

Each of the respective developing units 4*m*, 4*c*, 4*y*, and 4*bk* includes a developing roller 9, toner conveying screws 10*a* and 10*b*, a development casing 11, a doctor 12, and a magnetic permeability sensor 13. The details of these components included in each developing unit will be described later.

The optical writing unit 5 is disposed above the plurality of developing units 4*m*, 4*c*, 4*y*, and 4*bk*. The optical writing unit 5 emits respective laser light beams toward the photoconductive drums 2*m*, 2*c*, 2*y*, and 2*bk* and irradiates the respective surfaces of the photoconductive drums 2*m*, 2*c*, 2*y*, and 2*bk* to form respective electrostatic latent images.

The duplex printing unit 6 is disposed below the transfer belt 3 and is used for forming images on both sides of a recording medium.

The charging roller 7 is disposed opposite to each of the photoconductive drums 2*m*, 2*c*, 2*y*, and 2*bk* so as to charge respective surfaces of the photoconductive drums 2*m*, 2*c*, 2*y*, and 2*bk*.

The fixing unit 8 is disposed at an upper left side of the main body 1 of the image forming apparatus 100, which is the downstream side of the transfer belt 3. The fixing unit 8 fixes the color toner image formed on the recording medium by applying heat and pressure.

The image forming apparatus 100 further includes a plurality of respective cleaning units (not shown) corresponding to the plurality of photoconductive drums 2*m*, 2*c*, 2*y*, and 2*bk*. Each cleaning toner removes residual toner from the respective surfaces of the plurality of photoconductive drums 2*m*, 2*c*, 2*y*, and 2*bk*.

In FIG. 4, the detailed structure of a single photoconductive drum of the photoconductive drums 2*m*, 2*c*, 2*y*, and 2*bk* and a single developing unit of the developing units 4*m*, 4*c*, 4*y*, and 4*bk*, corresponding to the single photoconductive drum is described.

Since the above-described components indicated by "m", "c", "y", and "bk" used for the image forming operations have similar structures and functions, except that respective toner images formed thereon are of different colors, which are yellow, magenta, cyan, and black toners, the discussion in FIG. 4 uses reference numerals for specifying components of the image forming apparatus 100 without the suffixes.

As shown in FIG. 4, the developing unit 4 and the charging roller 7 are disposed opposite to the photoconductive drum 2. Each developing unit 4 includes a different color from the other developing units 4 so as to form a single color image corresponding to image data of each color. Specifically, the developing unit 4*m* includes magenta toner, the developing unit 4*c* includes cyan toner, the developing unit 4*y* includes yellow toner, and the developing unit 4*bk* includes black toner.

The developing unit 4 develops an electrostatic latent image formed on the photoconductive drum 2 into a single color toner image by applying a predetermined developing bias to the two-component developer.

The components for the developing unit 4 are arranged in the development casing 11. The development casing 11 has an opening (not shown) thereon, at a position facing the photoconductive drum 2.

The developing roller 9 is arranged in the vicinity of the photoconductive drum 2 or in contact with the surface of the photoconductive drum 2 while a portion thereof is exposed to the photoconductive drum 2 from the opening of the development casing 11.

The developing roller 9 serves as a developer bearing member that bears or carries the two-component developer including toner and magnetic carrier. The developing roller 9 includes a non-magnetic material, and a magnet roller that generates a magnetic field is fixedly disposed, surrounded by the non-magnetic material, in the developing roller 9.

The toner conveying screws 10*a* and 10*b* are disposed in the development casing 11 in a parallel manner to each other.

The doctor 12 serves as a regulating member that regulates an amount or a height of developer on a surface of the developing roller 9. The doctor 12 is disposed so as to lie adjacent to the developing roller 9.

The magnetic permeability sensor 13 is disposed between the toner conveying screws 10*a* and 10*b* so as to measure magnetic permeability or a toner density in the developer supplied in the developing unit 4.

Operations of the image forming apparatus 100 having the above-described structure are described below.

The image forming apparatus 100 employs a reversal developing system in which, for example, the surface of an organic photoconductive element is negatively charged and a two-component developer including negatively charged toner is used on said surface.

The image forming apparatus 100 starts to rotate the photoconductive drums 2*m*, 2*c*, 2*y*, and 2*bk* in a clockwise direction in FIG. 3, and applies a predetermined voltage between the photoconductive drums 2*m*, 2*c*, 2*y*, and 2*bk* and respective charging rollers including the charging roller 7 (see FIG. 4) corresponding to the respective photoconductive drums 2*m*, 2*c*, 2*y*, and 2*bk*. With the above-described operation, the respective surfaces of the photoconductive drums 2*m*, 2*c*, 2*y*, and 2*bk* are uniformly charged.

While the photoconductive drums 2*m*, 2*c*, 2*y*, and 2*bk* are rotated, the optical writing unit 5 emits respective laser light beams, for example, corresponding to image data of each color and irradiates the charged surfaces of the photoconductive drums 2*m*, 2*c*, 2*y*, and 2*bk* so as to form respective electrostatic latent images corresponding to each image data.

As the photoconductive drums 2*m*, 2*c*, 2*y*, and 2*bk* having charged surfaces are further rotated, the respective electrostatic latent images on the photoconductive drums 2*m*, 2*c*, 2*y*, and 2*bk* are conveyed to respective positions opposite to the developing units 4*m*, 4*c*, 4*y*, and 4*bk* corresponding to the photoconductive drums 2*m*, 2*c*, 2*y*, and 2*bk* so that the respective electrostatic latent images can be developed into respective single color toner images.

Since the consumable amount of toner contained in each of the developing units 4*m*, 4*c*, 4*y*, and 4*bk* depends on the image data, the corresponding toner is replenished according to an image area coverage and the detection result of the magnetic permeability sensor 13 (see FIG. 4) in each developing unit 4. With the above-described operation, the corresponding toner can be replenished to constantly maintain its appropriate amount in the developing unit 4.

Further, parameters, for example, a target value, a charged potential, and a light intensity of the magnetic permeability sensor 13 are set and reviewed according to results obtained through a process control performed at intervals of a printing operation of a predetermined reference number of transfer sheets. The reference number of transfer sheets to be printed may vary according to the target of the process control. Preferably, the reference number of printout sheets is within a range from 5 to 200 .

In the process control in this case, a plurality of pattern images Pbk, Pc, Pm, and Py, formed in halftone and/or in solid on the surfaces of the photoconductive drums 2*m*, 2*c*, 2*y*, and 2*bk*, respectively, or on the surface of the transfer belt 3 are detected to obtain respective toner masses of the plurality of pattern images Pbk, Pc, Pm, and Py so that the respective toner masses can be adjusted to respective target toner mass.

The recording medium is adhered and carried on the transfer belt 3 to be conveyed. The above-described yellow, magenta, cyan, and black toner images are sequentially overlaid on a surface of the recording medium carried by the transfer belt 3 so that a full-color toner image can be formed after the recording medium has passed the photoconductive drum 2*bk* .

The recording medium having the full-color toner image thereon is then conveyed to the fixing unit 8 located at the downstream side in the sheet traveling direction. The fixing unit 8 applies heat and pressure to the recording medium. With the above-described operation, the toner adhered on the recording medium may melt and the full-color image may be produced onto the recording medium. The recording medium having the fixed full-color image is further conveyed to discharge to a sheet discharging tray (not shown).

Residual toner remaining on the surfaces of the photoconductive drums 2*m*, 2*c*, 2*y*, and 2*bk* is removed by the respective cleaning units (not shown). Electric charges remaining on the respective surfaces of the photoconductive drums 2*m*, 2*c*, 2*y*, and 2*bk* are optically discharged by respective discharging lamps (not shown). Thus, the above-described image forming operations are repeatedly performed.

Each photoconductive drum 2 has respective surface potentials. For example, a background area potential or a potential of a dark area VD is set to approximately −800V and an image area potential or a potential of a light area VL is set to approximately −50V. The developing operation may be performed according to a difference with respect to a developing bias potential VB having the set value of approximately −800V.

Figure 5:
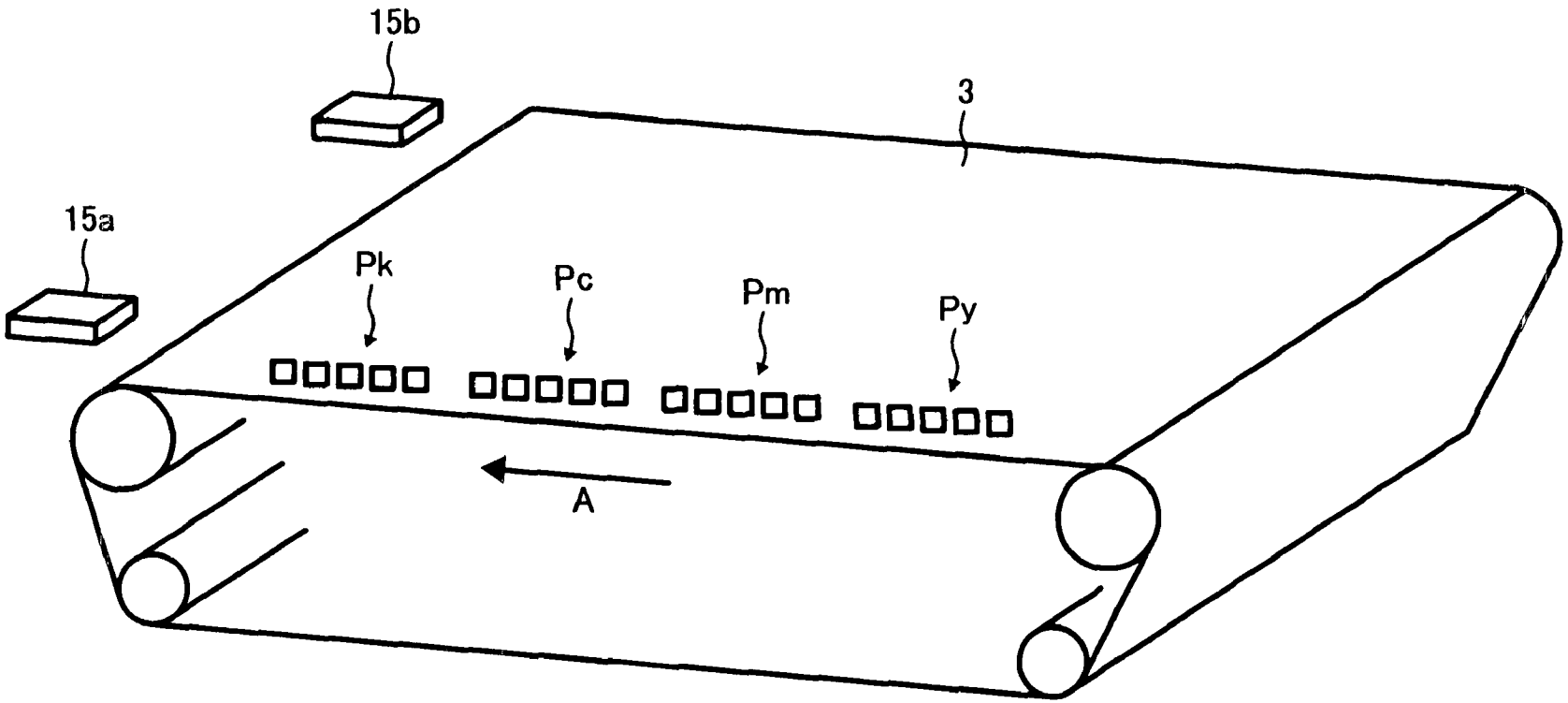
FIG. 5 is an enlarged view of a transfer belt of the image forming apparatus of FIG. 3, according to an exemplary embodiment of the present invention.

FIG. 5 shows a detailed structure of the transfer belt 3 provided in the image forming apparatus 100.

In FIG. 5, photosensors 15*a* and 15*b* are disposed on both sides of the transfer belt 3 in a sheet traveling direction indicated by arrow A of FIG. 5. The photosensor 15*a* is arranged on the left side of the transfer belt 3 with respect to the sheet traveling direction and the photosensor 15*b* is arranged on the right side of the transfer belt 3 with respect to the sheet traveling direction.

The photosensors 15*a* and 15*b* adjust color shift that may be caused on both sides. Adjusting methods that are commonly known are accordingly employed for calibrating color shift and image density with two photosensors.

In the image forming apparatus 100 according to an exemplary embodiment, a P-sensor is employed for controlling the image density. Specifically, a latent image pattern is formed at a reference potential on the surface of the photoconductive drum 2, and the developing unit 4 develops the latent image pattern into a toner image. Then, as shown in FIG. 5, the photosensors 15*a* and 15*b*, which are P-sensors, output respective detected signal voltages "VSG" corresponding to the respective reflected lights from the plurality of pattern images Pbk, Pc, Pm, and Py.

Figure 6:
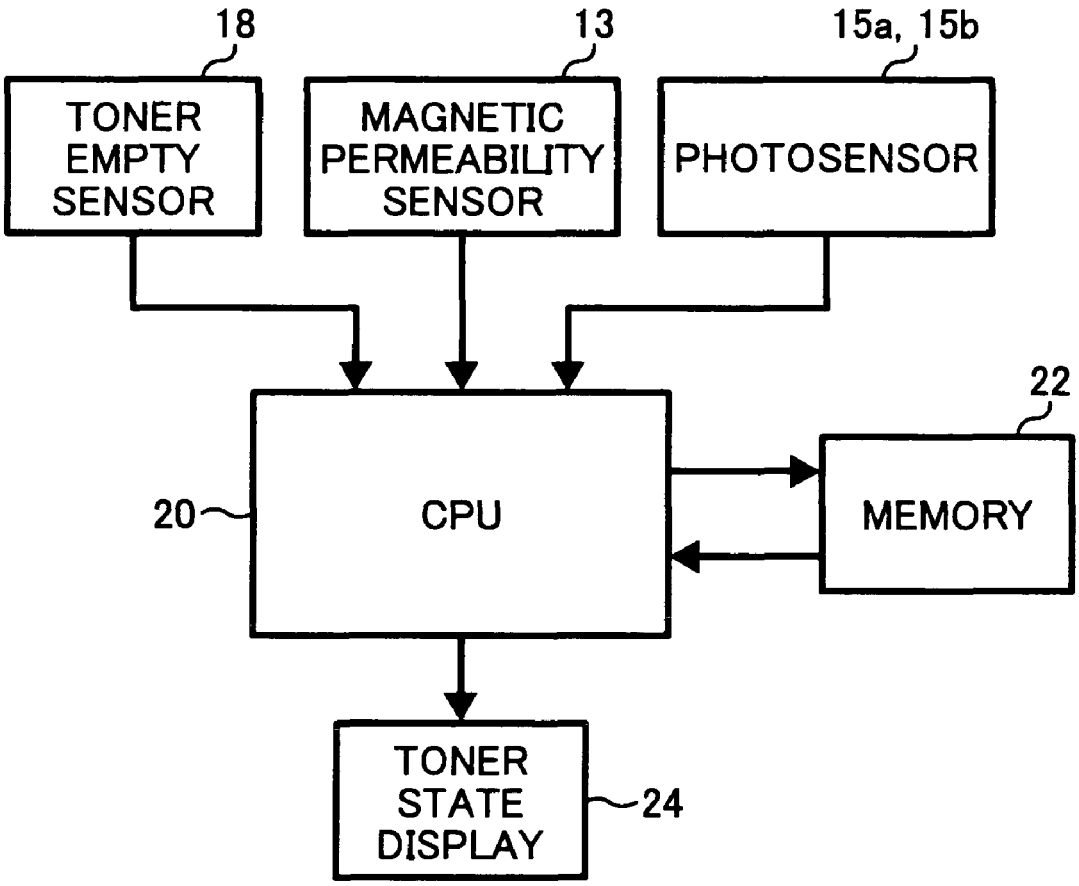
FIG. 6 is a block diagram showing a schematic structure of a controlling portion of the image forming apparatus of FIG. 3.

Referring to FIG. 6, a block diagram of a schematic structure of a controlling portion of the image forming apparatus 100 is described.

In FIG. 6, the image forming apparatus 100 includes the magnetic permeability sensor 13, the photosensors 15*a* and 15*b*, a toner empty sensor or a TE sensor 18, a central processing unit or CPU 20, an image pixel memory 22, and a toner state display 24.

The magnetic permeability sensor 13 serves as a toner density sensor and detects the toner density in the developing unit 4.

Both of the photosensors 15*a* and 15*b* serve as an optical sensor and optically detect respective densities of the plurality of pattern images Pbk, Pc, Pm, and Py that are formed between transfer sheets during an image forming operation under a predetermined image forming condition. The detected densities are represented as detection signal levels, "MPA", including a reference level to achieve.

The TE sensor 18 is disposed in a toner conveying path (not shown). The TE sensor 18 detects the toner almost empty state in a toner supplying unit (not shown) that accommodates toner of color corresponding to image data.

The image pixel memory 22 serves as a storing unit that stores an image area coverage of each color of an output image. That is, the image pixel memory 22 stores data of pixels used for an image and stores respective image area coverages corresponding to the magenta, cyan, yellow, and black toners of an output image.

The CPU 20 serves as a determining unit that determines whether the toner in the toner supplying unit is in the toner almost empty state or in the toner empty state or neither, based on the detection results obtained by the magnetic permeability sensor 13 and the photosensors 15*a* and 15*b*. The CPU 20 also works as a controlling unit that continuously performs a toner state check when the image area coverage of the output image is greater than a predetermined image area coverage and the density of the reference pattern image is greater than a predetermined density or detection signal level even after the toner in the toner supplying unit is either in the toner almost empty state or in the toner empty state.

The toner state display 24 is a display to indicate the state of toner remaining in the toner supplying unit. That is, the toner state display 24 shows that the toner is in the toner almost empty state or that the toner is in the toner empty state or neither.

Figure 7:
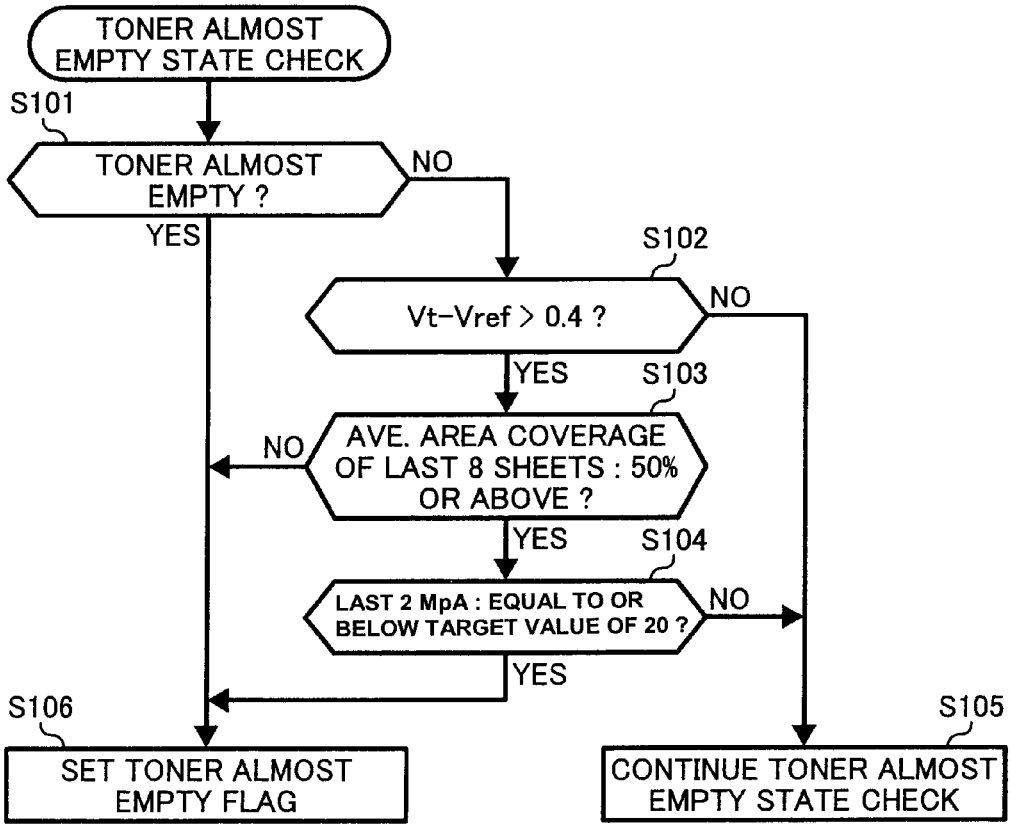
FIG. 7 is a flowchart of an operation performed by the image forming apparatus of FIG. 3, according to an exemplary embodiment of the present invention.
Figure 8:
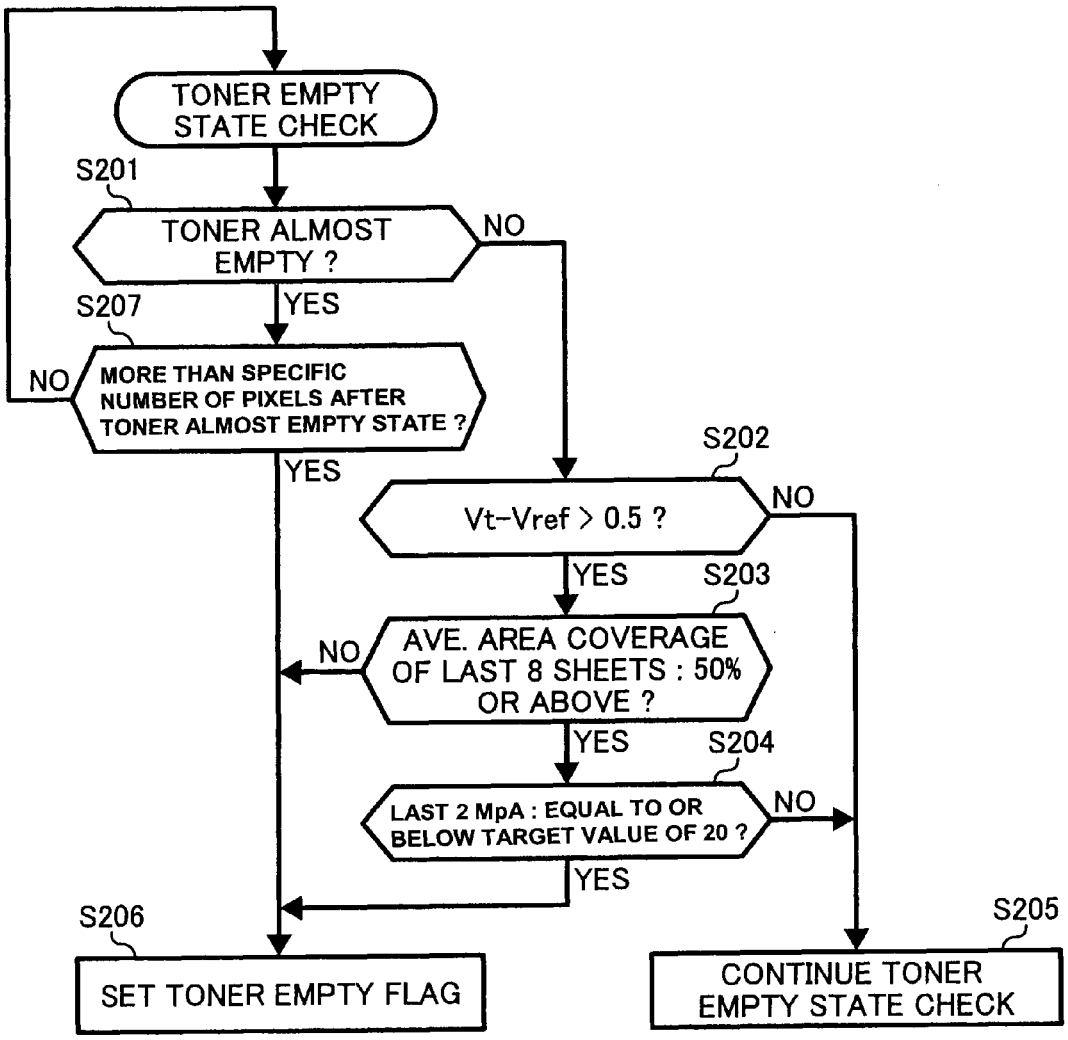
FIG. 8 is a flowchart of a different operation performed by the image forming apparatus of FIG. 3, according to an exemplary embodiment of the present invention.

Referring to FIGS. 7 and 8, flowcharts of respective operations for detecting toner states in the image forming apparatus 100 according to an exemplary embodiment are described.

FIG. 7 shows the operation flow chart of a toner almost empty detecting check of the image forming apparatus 100 according to an exemplary embodiment of the present invention.

In step S101, the TE sensor 18 determines whether the toner almost empty state of the toner supplying unit has been detected.

When the toner almost empty state has been detected, the determination result of step S101 is YES, and the process goes to step S106.

When the toner almost empty state has not been detected, the determination result of step S101 is NO, and the process goes to step S102.

In step S102, the CPU 20 of the image forming apparatus 100 obtains a target toner density (Vref) and a current toner density (Vt) and determines whether a difference between the target toner density (Vref) and the current toner density (Vt) is greater than a predetermined value, 0.4V for example, continuously for a given number "n" of transfer sheets.

When the difference is greater than 0.4V, the determination result of step S102 is YES, the process goes to step S103.

When the difference is equal to or smaller than 0.4V, the determination result of step S102 is NO, the process goes to step S105.

In step S103, the CPU 20 of the image forming apparatus 100 determines whether the average image area coverage of the last 8 printed sheets is equal to or greater than a reference value, 50% for example.

When the average image area coverage is equal to or greater than 50%, the determination result of step S103 is YES, and the process goes to step S104.

When the average image area coverage is smaller than 50%, the determination result of step S103 is NO, and the process goes to step S106.

In step S104, the CPU 20 of the image forming apparatus 100 determines whether the density levels (MpA) of the last two patterns formed between transfer sheets during an image forming operation under the predetermined image forming condition are equal to or lower than a predetermined density level, Level 20 for example.

When the density levels (MpA) of the last two patterns are equal to or lower than Level 20, the determination result of step S104 is YES, and the process goes to step S106.

When the density levels (MpA) of the last two patterns are greater than Level 20, the determination result of step S104 is NO, and the process goes to step S105.

In step S105, the CPU 20 of the image forming apparatus 100 leaves a toner almost empty flag unset and continues to perform the toner almost empty state check.

In step S106, the CPU 20 of the image forming apparatus 100 sets the toner almost empty flag and indicates a message or warning that the toner in the toner supplying unit is in the toner almost empty state.

As previously described, when an image having high image area coverage is continuously copied or printed, the fluidity and bulk density of the developer can vary. This condition can cause an increase of the current toner density (Vt), which may trigger the erroneous detection of the toner almost empty state. With the above-described toner almost empty detecting check performed by the image forming apparatus 100 according to an exemplary embodiment of the present invention, the erroneous detection of the toner almost empty state can effectively be reduced or prevented.

FIG. 8 shows the operation flow chart of a toner empty detecting check of the image forming apparatus 100 according to an exemplary embodiment of the present invention.

In step S201, the TE sensor 18 determines whether the toner almost empty state of the toner supplying unit has been detected.

When the toner almost empty state has been detected, the determination result of step S201 is YES, and the process goes to step S207.

In step S207, the CPU 20 of the image forming apparatus 100 determines whether a specific number of pixels has been output.

When the specific number of pixels has been output, the determination result of step S207 is YES, and the process proceeds to step S206.

When the specific number of pixels has not yet been output, the determination result of step S207 is NO, and the S image forming apparatus 100 starts the toner empty state check again.

When the toner empty state has not been detected in step S201, the determination result of step S201 is NO, and the process goes to step S202.

In step S202, the CPU 20 of the image forming apparatus 100 obtains a target toner density (Vref) and a current toner density (Vt) and determines whether a difference between the target toner density (Vref) and the current toner density (Vt) is greater than a predetermined value, 0.5V for example, continuously for a given number "n" of transfer sheets.

When the difference is greater than 0.5V, the determination result of step S202 is YES, the process goes to step S203.

When the difference is equal to or smaller than 0.5V, the determination result of step S202 is NO, the process goes to step S205.

In step S203, the CPU 20 of the image forming apparatus 100 determines whether the average image area coverage of the last 8 printed sheets is equal to or greater than a reference value, 50%, for example.

When the average image area coverage is equal to or greater than 50%, the determination result of step S203 is YES, and the process goes to step S204.

When the average image area coverage is smaller than 50%, the determination result of step S203 is NO, and the process goes to step S206.

In step S204, the CPU 20 of the image forming apparatus 100 determines whether the density levels (MpA) of the last two patterns formed between transfer sheets during an image forming operation under the predetermined image forming condition are equal to or lower than a predetermined density level, Level 20 for example.

When the density levels (MpA) of the last two patterns are equal to or lower than Level 20, the determination result of step S204 is YES, and the process goes to step S206.

When the density levels (MpA) of the last two patterns are greater than level 20, the determination result of step S204 is NO, and the process goes to step S205.

In step S205, the CPU 20 of the image forming apparatus 100 leaves a toner empty flag unset and continues to perform the toner empty state check.

In step S206, the CPU 20 of the image forming apparatus 100 sets the toner empty flag and indicates a message or warning that the toner in the toner supplying unit is in the toner empty state.

According to the same reason as the above-described toner almost empty detecting check shown in the operation flow chart of FIG. 7, the above-described toner empty detecting check performed by the image forming apparatus 100 according to an exemplary embodiment of the present invention can reduce or prevent the erroneous detection of the toner empty state caused by the variation of the fluidity and bulk density of the developer when an image having high image area coverage is continuously printed.

As previously described, the two-component developer in the corresponding developing unit 4 can be replaced for abrasion or wear thereof.

When the two-component developer is replaced, the CPU 20 of the image forming apparatus 100 deletes the data of average image area coverage stored in the image pixel memory 22.

Further, the developing units 4*m*, 4*c*, 4*y*, and 4*bk* accommodating the two-component developer are separately detachable with respect to the image forming apparatus 100 for the replacement thereof due to the end of life.

When any of the developing units 4*m*, 4*c*, 4*y*, and 4*bk* is replaced, the CPU 20 of the image forming apparatus 100 also deletes the data of average image area coverage stored in the image pixel memory 22.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus, comprising:

an optical sensor configured to optically detect a density of a reference pattern image at intervals of printing a predetermined number of transfer sheets;

a toner density sensor configured to detect a density of toner included in a two-component developer accommodated in a developing unit;

a toner empty sensor configured to detect an almost empty state in a toner supplying unit;

a storing unit configured to store an image area coverage of an output image;

a determining unit configured to determine, when the toner empty sensor detects that the toner supplying unit is not in the almost empty state, whether a state of toner accommodated in the toner supplying unit is the almost empty state or an empty state or neither by comparing the density of the toner detected by the toner density sensor with a target toner density and, when the density of the toner detected is below the target toner density by a predetermined value, comparing an average image area coverage of a predetermined number of sheets with a reference value, wherein the determining unit determines that the toner is in the almost empty state or the empty state when the average image area coverage is not equal to or above a predetermined percentage of the reference value; and a controlling unit configured to control to continuously perform a toner state check when the image area coverage of the output image is greater than a predetermined image area coverage value and the density of the reference pattern image is greater than a predetermined density level, even after the toner density sensor detects a low density of toner and the determining unit determines the state of toner is the almost empty state or the empty state or neither, wherein:

when the average image area coverage is equal to or above a predetermined percentage of the reference value, the determining unit determines whether density levels of two last patterns formed are equal to or lower than a predetermined density level, and the determining unit determines that the toner is in the almost empty state or the empty state when the determining unit determines that the density levels of the two last patterns formed are equal to or lower than the predetermined density level.

2. The image forming apparatus according to claim 1, wherein:

the controlling unit deletes data of the average image area coverage when the two-component developer in the developing unit is replaced.

3. The image forming apparatus according to claim 1, wherein:

the controlling unit deletes data of the average image area coverage when the developing unit is replaced.

4. The image forming apparatus according to claim 1, wherein:

a toner almost empty warning flag is set when the toner density sensor detects a low density of toner and the determining unit determines the state of toner is the almost empty state.

5. The image forming apparatus according to claim 1, wherein:

a toner empty warning flag is set when the toner density sensor detects a low density of toner and the determining unit determines the state of toner is the empty state.

6. The image forming apparatus according to claim 1, wherein:

the image forming apparatus tracks pixel output.

7. The image forming apparatus according to claim 6, wherein:

the image forming apparatus sets a toner empty warning flag when a predetermined number of pixels have been output.

8. The image forming apparatus according to claim 1, wherein: the predetermined percentage is 50%.

9. The image forming apparatus according to claim 1, wherein:

the determining unit determines that the toner is not in the almost empty state or the empty state when the determining unit determines that the density levels of the two last patterns formed are above the predetermined density level.

10. The image forming apparatus according to claim 1, wherein:

the determining unit determines that the toner is not in the almost empty state or the empty state when the density of the toner detected is not below the target toner density by the predetermined value.

11. The image forming apparatus according to claim 1, wherein:

the predetermined value of the difference between the density of the toner detected by the toner density sensor and the target toner density is 0.4.

12. The image forming apparatus according to claim 1, wherein:

the predetermined value of the difference between the density of the toner detected by the toner density sensor and the target toner density is 0.5.

* * * * *